US009593285B2

(12) United States Patent
D'Acosta

(10) Patent No.: US 9,593,285 B2
(45) Date of Patent: Mar. 14, 2017

(54) UNLEADED GASOLINE FORMULATIONS INCLUDING MESITYLENE AND PSEUDOCUMENE

(71) Applicant: Swift Fuels, LLC, West Lafayette, IN (US)

(72) Inventor: Chris D'Acosta, West Lafayette, IN (US)

(73) Assignee: Swift Fuels, LLC, West Lafayette, IN (US)

( * ) Notice: Subject to any disclaimer, the term of this patent is extended or adjusted under 35 U.S.C. 154(b) by 22 days.

(21) Appl. No.: 14/268,567

(22) Filed: May 2, 2014

(65) Prior Publication Data

US 2014/0357908 A1 Dec. 4, 2014

Related U.S. Application Data

(60) Provisional application No. 61/818,580, filed on May 2, 2013.

(51) Int. Cl.

| | |
|---|---|
| ***C10L 1/16*** | (2006.01) |
| ***C10L 1/04*** | (2006.01) |
| ***C10L 1/06*** | (2006.01) |
| ***C10L 10/10*** | (2006.01) |

(52) U.S. Cl.

CPC *C10L 1/04* (2013.01); *C10L 1/06* (2013.01); *C10L 1/1608* (2013.01); *C10L 10/10* (2013.01); *C10L 2270/023* (2013.01)

(58) Field of Classification Search

CPC .... C10L 1/04; C10L 10/10; C10L 1/06; C10L 1/1608; C10L 2270/023

USPC ..... 585/1, 14

See application file for complete search history.

(56) References Cited

U.S. PATENT DOCUMENTS

| | | | |
|---|---|---|---|
| 2,593,561 | A | 4/1952 | Herbst et al. |
| 5,470,358 | A | 11/1995 | Gaughan |
| 6,353,143 | B1 | 3/2002 | Fang et al. |
| 8,049,048 | B2 | 11/2011 | Rusek et al. |
| 8,628,594 | B1 | 1/2014 | Braly |

(Continued)

FOREIGN PATENT DOCUMENTS

WO WO 2007/004789 A1 1/2007

OTHER PUBLICATIONS

International Search Report and Written Opinion issued in PCT/US2014/036646, dated Sep. 17, 201416 pgs.

*Primary Examiner* — Pamela H Weiss

(74) *Attorney, Agent, or Firm* — Woodard, Emhardt, Moriarty, McNett & Henry LLP

(57) ABSTRACT

The present invention provides an unleaded, piston engine fuel formulation comprising a blend of mesitylene, pseudocumene and isopentane having a MON of at least 94 and an RVP of 38 to 49 kPa at 37.8° C. In certain aspects, the formulation comprises specific weight percentages of each of the mesitylene, pseudocumene and isopentane components, and varying MON ratings. In additional aspects, the formulations comprise a combination of mesitylene, isopentane, and one or more additional components selected from the group consisting of pseudocumene, toluene and xylenes. In certain embodiments, the formulations also include alkylates and or alkanes. The formulations have unusually high MON ratings, and desirable RVP and distillation curve characteristics for formulations not including additional components, particularly octane boosters.

17 Claims, 4 Drawing Sheets

(56) References Cited

U.S. PATENT DOCUMENTS

| | | | | |
|---|---|---|---|---|
| 8,686,202 | B2 | 4/2014 | Rusek et al. | |
| 2012/0029251 | A1 | 2/2012 | Hemighaus et al. | |
| 2013/0139431 | A1* | 6/2013 | Russo | C10L 1/1824 44/451 |

* cited by examiner

Table 4 - Pseudocumene as % P:M (Isopentane held constant)

D7719 Minimum Motor Octane Number for Unleaded 100 Octane Avgas

D910 Minimum Motor Octane Number for Leaded 100 Octane Avgas

UNLEADED GASOLINE FORMULATIONS INCLUDING MESITYLENE AND PSEUDOCUMENE

BACKGROUND OF THE INVENTION

Field of the Invention

The present invention relates to piston engine fuels comprising mesitylene, pseudocumene and isopentane. These fuels may optionally include other components, particularly to modify characteristics as to octane rating, RVP, boiling point, cold start, smoke and deposits.

Description of the Prior Art

Three trimethylbenzene isomers are routinely found in the $C_9$ aromatic stream of the refining process. They are often blended as aromatic hydrocarbons straight into the gasoline pool without separation, unless a unique need for separating the isomers is found, such as using mesitylene as a specialty solvent (e.g., as a developer for photopatternable silicones) or pseudocumene as a feedstock for trimellitic anhydride (TMA). Because the separation of the isomers is so challenging, and thereby commercially expensive, the processing cost often prohibits their consideration as a primary component for most aviation gasoline products.

U.S. Pat. No. 8,049,048 B2 entitled "Renewable Engine Fuel," describes a two component aviation fuel comprised of 75-90% mesitylene and 15-30% isopentane. This patent uses the 1,3,5-trimethylbenzene C9 component that is the most difficult to separate, and fails to adequately leverage the less expensive C9 trimethyl aromatics components that contribute to high octane, primarily needed for high compression engines in the marketplace that consume aviation gasoline. U.S. Pat. No. 8,686,202 also discloses a high octane avgas combining mesitylene and isopentane.

Many other attempts have been made at devising a high-octane aviation gasoline starting from a base aviation fuel, some by combining alkylates up to 80%, as well as 5-15% of additional compounds to increase the octane and reduce the vapor pressure to aviation gasoline standards. See, for example, U.S. Pat. Nos. 8,628,594 and 5,470,358. One approach has involved the use of aromatic amines which may present a toxicity risk.

SUMMARY OF THE INVENTION

In accordance with the present invention there are provided novel formulations of 1,2,4-trimethylbenzene (pseudocumene), 1,3,5-trimethylbenzene (mesitylene), and isopentane. These formulations provide an unexpectedly high octane, unleaded fuel suitable for motor fuel and aviation gasoline and a wide variety of related fuel products. Previous tests using 1,3,5-trimethylbenzene indicated that a very large concentration was required to reap a high enough motor octane number (MON) to achieve a high Anti-Knocking Index, especially required for aviation gasoline. However, it has been determined that the combination of pseudocumene and mesitylene generates an unexpectedly high MON which also provides a more commercially viable unleaded (no lead) aviation gasoline product.

DESCRIPTION OF THE PREFERRED EMBODIMENT

Figure 1:
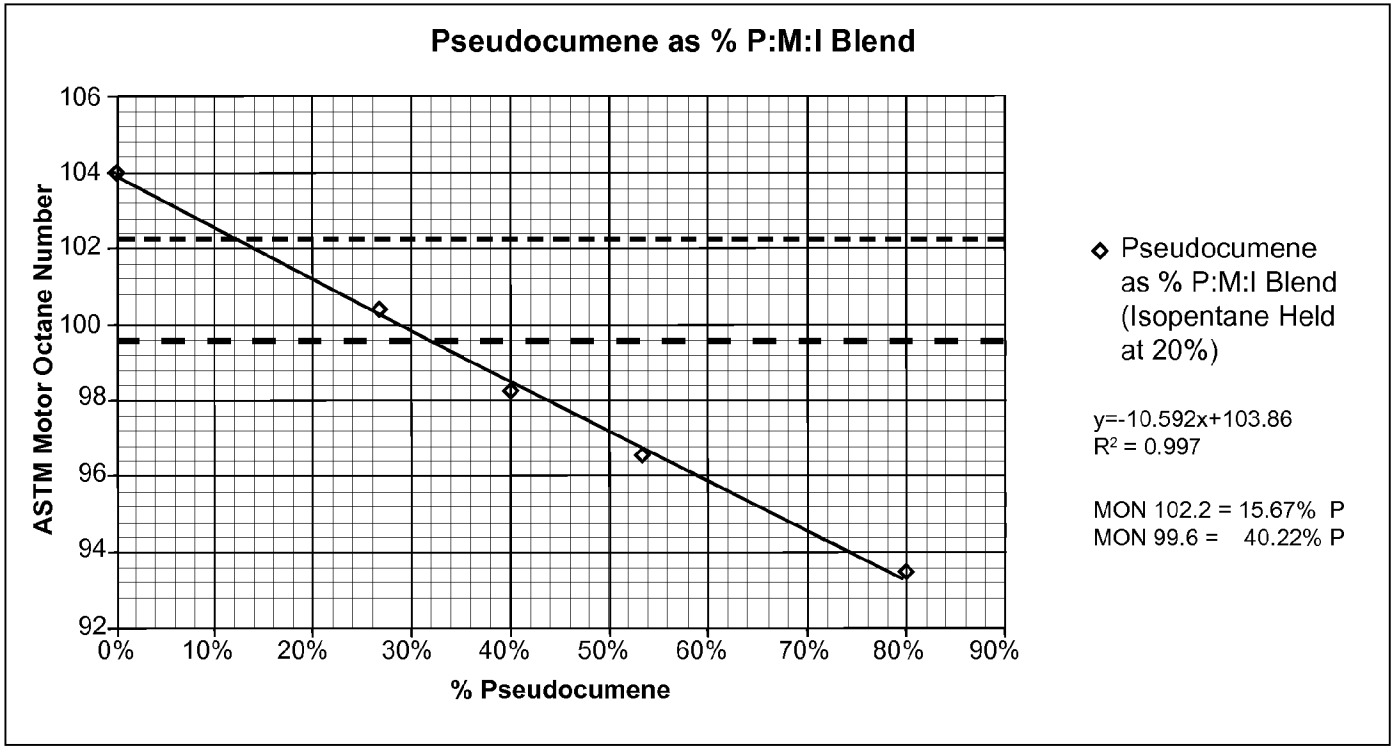
FIG. 1 is a graph showing pseudocumene as a percentage of a blend of pseudocumene, mesitylene and 20% isopentane, and the corresponding ASTM Motor Octane Numbers for the various blends.

For the purposes of promoting an understanding of the principles of the invention, reference will now be made to certain embodiments and specific language will be used to describe the same. It will nevertheless be understood that no limitation of the scope of the invention is thereby intended, such alterations and further modifications, and such further applications of the principles of the invention as described herein, being contemplated as would normally occur to one skilled in the art to which the invention relates.

Motor fuels are used in a variety of systems. In the broadest sense, a motor fuel is one which is used in piston or turbine engines. The present invention is directed to fuels for piston engines useful in ground vehicles and/or aircraft. Typically, ground vehicles can use relatively lower octane fuels, while aircraft require higher octane fuels. A basic determinant as to the choice of fuels is the octane rating of the fuel compared to the compression of the engine. For example, higher compression engines generally require higher octane fuels. This invention provides fuels suitable generally for piston engines. Certain embodiments are particularly applicable for use in aircraft engines.

MON and Anti-Knock:

Motor fuel must meet the power demands for the selected engines. The motor octane number, or MON, is a standard measure of the performance of a fuel. A gasoline-fueled reciprocating engine requires fuel of sufficient octane rating to prevent uncontrolled combustion known as engine knocking ("knock" or "ping"). The higher the MON, the more compression the fuel can withstand before detonating. In broad terms, fuels with a higher motor octane rating are most useful in high-compression engines that generally have higher performance. The MON is a measure of how the fuel behaves when under load (stress). ASTM test method 2700 describes MON testing using a test engine with a preheated fuel mixture, 900 rpm engine speed, and variable ignition timing to stress the fuel's knock resistance. The MON of an aviation gasoline fuel can be used as a guide to the amount of knock-limiting power that may be obtained in a full-scale engine under take-off, climb and cruise conditions.

A particular aspect of the present invention is to provide formulations which are useful as piston engine fuels, and are particularly suited for use as aviation gasoline. Aviation gas, or avgas, has a number of special requirements as compared to ground vehicle gasoline. Aviation gasoline is an aviation fuel used in spark-ignited (reciprocating) piston engines to propel aircraft. Avgas is distinguished from mogas (motor gasoline), which is the everyday gasoline used in motor vehicles and some light aircraft.

Most grades of avgas have historically contained tetraethyl lead (TEL), a toxic substance used to prevent engine knocking (detonation). This invention produces an unleaded grade of avgas with fuel properties that meet the minimum power rating (motor octane number), appropriate combustion anti-knocking (detonation suppression), volatility (vapor pressure), and related criteria. The inventive fuels allow a range of piston engine aircraft, including those with high-compression engines, to perform effectively to manufacturer requirements. It is necessary that avgas provide sufficient power under varying conditions, including take-off and climb as well as at cruise.

Various MON ratings are considered to be base requirements for aircraft use, depending on the type of engine and other factors. The present invention provides aviation fuels which have a MON of at least 100, preferably 102 or greater. A second consideration can be the research octane number (RON), which is determined similarly to MON but under lower RPMs.

RVP:

The vapor pressure of a fuel is another important factor for avgas. Aircraft engines operate in wide ranges of temperatures and atmospheric pressures (e.g., altitudes), and the fuels must start and provide sufficient combustion characteristics throughout those ranges. Lower vapor pressure levels are desirable in avoiding vapor lock during summer heat, and higher levels of vaporization are desirable for winter starting and operation. Fuel cannot be pumped when there is vapor in the fuel line (summer) and winter starting ("cold start') will be more difficult when liquid gasoline in the combustion chambers has not vaporized. Vapor pressure is critically important for aviation gasolines, affecting starting, warm-up, and tendency to vapor lock with high operating temperatures or high altitudes.

The ability of an aviation gas to satisfy the foregoing requirements may be assessed based on the Reid Vapor Pressure (RVP). The Reid vapor pressure is the absolute vapor pressure exerted by a liquid at 37.8° C. (100° F.) as determined by the test method ASTM-D323. The RVP differs from the true vapor pressure due at least in part to the presence of water vapor and air in the confined space. A typical requirement for avgas is that it has an RVP of 38-49 kilopascals (kPa) at 37.8° C., as determined in accordance with applicable ASTM standards.

Insolubility

Avgas must also be highly insoluble in water. Water dissolved in aviation fuels can cause serious problems, particularly at altitude. As the temperature lowers, the dissolved water becomes free water. This then poses a problem if ice crystals form, clogging filters and other small orifices, which can result in engine failure.

The present invention provides fuel formulations which are capable of meeting all of these strict requirements. They meet the MON standards, have suitable RVP and are not soluble in water. In a preferred embodiment, the formulations of the present invention meet the specifications set forth in ASTM D7719 for a high aromatic, unleaded hydrocarbon based aviation fuel.

EXAMPLE 1

Mesitylene with a MON rating of 136 would be expected to have a substantially greater impact on the MON rating of the fuel formulations than pseudocumene, which has a MON of 124. However, based upon testing on blend ratios as depicted below, the unexpected result was that pseudocumene was found to be a viable component with up to about 16% combined with about 64% mesitylene and about 20% isopentane. See Table 1. In addition, pseudocumene at a level of up to 40% was found to be a viable component for 98.3 MON aviation fuel with 40% mesitylene and 20% isopentane by weight. See FIG. 1. It is therefore evident that various formulations comprising these three components, and particularly consisting essentially of these components, yield fuel candidates having desired MON ratings.

TABLE 1

Table 1 - MON Tests (using ASTM D2700)
D2700 Motor Octane Number Test - Aviation Gasoline Blends

| P/(P + M + I) % | Pseudocumene (ml) | Mesitylene (ml) | Isopentane (ml) | ASTM MON |
|---|---|---|---|---|
| 80% | 80 | 0 | 20 | 93.5 |
| 53% | 53.3 | 26.7 | 20 | 96.6 |
| 40% | 40 | 40 | 20 | 98.3 |
| 27% | 26.7 | 53.3 | 20 | 100.4 |
| 0% | 0 | 80 | 20 | 104 |

(M) Mesitylene = 1,3,5-trimethylbenzene
(P) Pseudocumene = 1,2,4-trimethylbenzene
(I) Isopentane

Reid Vapor Pressure

Testing also demonstrated that the formulations provide acceptable RVP. For example, ten formulations of mesitylene and pseudocumene were tested, with isopentane being held at a constant at 20 vol %. The volume percentages of pseudocumene were varied as a vol % of the combination of pseudocumene (P) and mesitylene (M). The tests were conducted in accordance with ASTM methods. The vapor pressure of pseudocumene (2.03 mm Hg at 25° C.) differs substantially from that of mesitylene (48.2 mm Hg at 25° C.). However, unexpectedly, the testing revealed that the RVP remained almost constant. See Table 2, and FIG. 2.

TABLE 2

RVP Test (using ASTM D5191)
Temperature for Table 2 - 38.7° C.
Table 2 - Reid Vapor Pressure Test - Aviation Gasoline Blends

| P/(P + M) % | Mesitylene (ml) | Pseudocumene (ml) | Isopentane (ml) | RVP (psi) | RVP n(kPa) |
|---|---|---|---|---|---|
| 10% | 36 | 4 | 10 | 5.71 | 39.37 |
| 20% | 32 | 8 | 10 | 5.76 | 39.71 |
| 30% | 28 | 12 | 10 | 5.72 | 39.44 |
| 40% | 24 | 16 | 10 | 5.70 | 39.30 |
| 50% | 20 | 20 | 10 | 5.74 | 39.58 |
| 60% | 16 | 24 | 10 | 5.73 | 39.51 |
| 70% | 12 | 28 | 10 | 5.68 | 39.16 |
| 80% | 8 | 32 | 10 | 5.74 | 39.58 |
| 90% | 4 | 36 | 10 | 5.77 | 39.78 |
| 100% | 0 | 40 | 10 | 5.75 | 39.64 |

Figure 2:
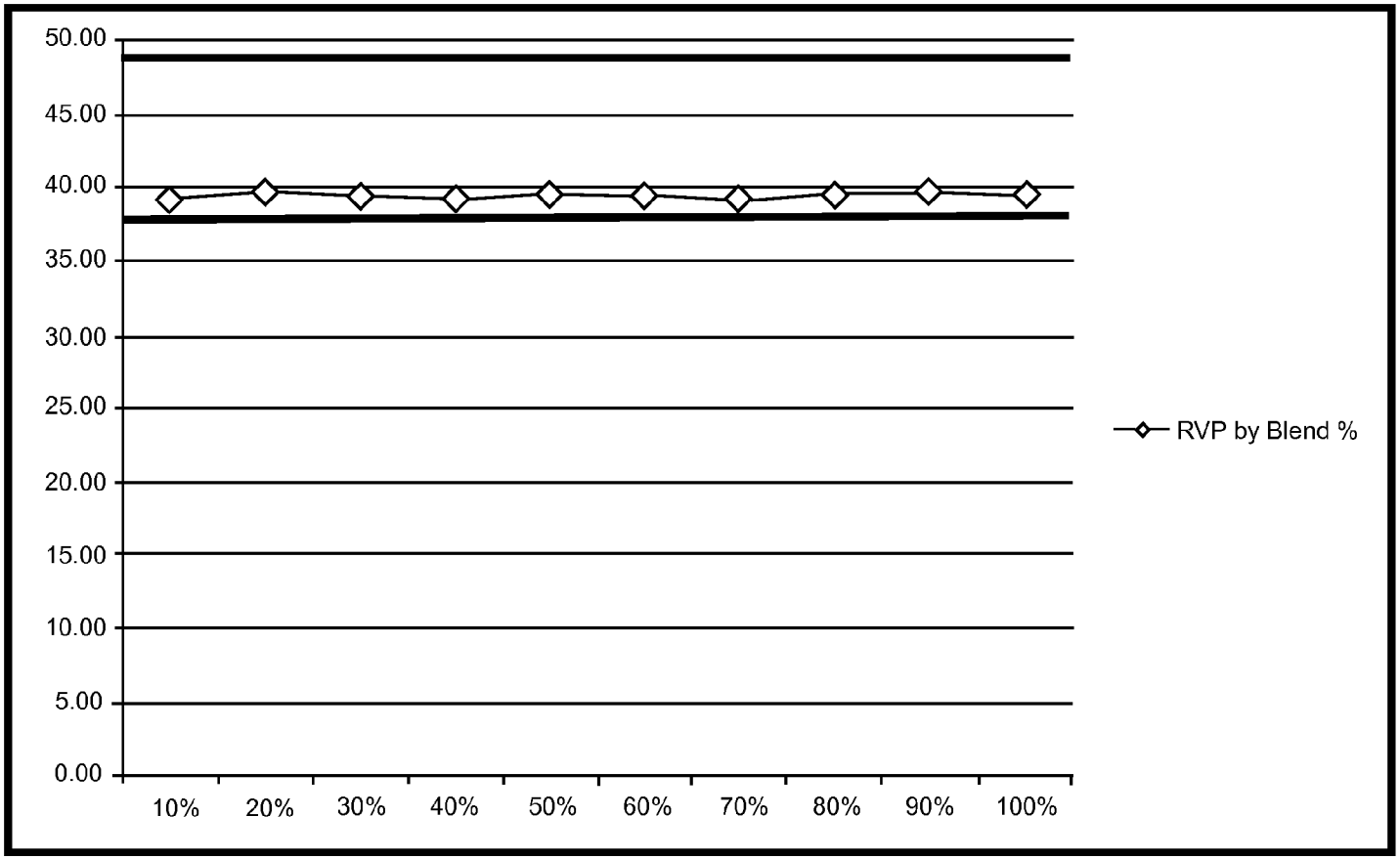
FIG. 2 is a graph showing the Reid Vapor Pressure compared to Blend % for various blends comprising pseudocumene, mesitylene and 20% isopentane.

(M) Mesitylene = 1,3,5-trimethylbenzene
(P) Pseudocumene = 1,2,4-trimethylbenzene The RVP test results for the various mixtures were unexpectedly consistent and similar. The minimum acceptable RVP is depicted in FIG. 2 at 38 kPa and the maximum at 49 kPa as defined by the ASTM D5191 using vapor pressure at 38.7° C. All of the formulations tested fell within the acceptable limits. While these tests were based on vol %, it is apparent due to the relative densities of the components that the results would not significantly differ using wt %.

Based on the foregoing testing, it is shown that formulations according to the present invention provide fuels have desirably high MON and acceptable RVP characteristics. Testing with a 20% isopentane component shows that these attributes are readily obtained combining the three components. It has also been shown, for example in U.S. Pat. No. 8,049,048, also owned by applicant, that combinations of 15-30 wt % isopentane with 70-85 wt % mesitylene, provide useful fuels with high MON. The disclosure of that patent is hereby incorporated by reference in its entirety. For combinations of mesitylene, pseudocumene and isopentane with isopentane in the range of 15.5 to 21.2 wt %, high MON and acceptable RVP rated fuels are obtained.

Distillation Curve

Testing confirmed that the inventive formulations met the distillation curve requirements as well. A distillation curve analysis was performed by blending 3 different samples: an 80% component comprising pseudocumene and mesitylene with the mixture including (a) 30% pseudocumene, (b) 60% pseudocumene, or (c) 100% pseudocumene by wt, plus a constant component of 20% isopentane. These blends therefore comprised (a) 24% P, 56% M and 20% I, (b) 48% P, 32% M, and 20% I, and (c) 80% P, 0% M and 20% I, respectively. See Table 3, below.

TABLE 3

ASTM D86 - Distillation Curve Pseudocumene and Mesitylene

| Fuel Evaporated (%) | Temp. (° C.) 30% P | Fuel Evaporated (%) | Temp. (° C.) 60% P | Fuel Evaporated (%) | Temp. (° C.) 100% P |
|---|---|---|---|---|---|
| 0% | 27 | 0% | 27 | 0% | 25 |
| 5% | 34 | 5% | 35 | 5% | 34 |
| 10% | 40 | 10% | 40 | 8% | 38 |
| 15% | 45 | 15% | 44 | 10% | 39 |
| 18% | 50 | 20% | 46 | 15% | 42 |
| 20% | 52 | 24% | 48 | 17% | 45 |
| 24% | 66 | 23% | 55 | 18% | 47 |
| 25% | 155 | 24% | 157 | 20% | 51 |
| 30% | 163 | 33% | 164 | 23% | 53 |
| 35% | 163 | 35% | 165 | 24% | 62 |
| 40% | 163 | 40% | 165 | 25% | 158 |
| 45% | 164 | 45% | 165 | 30% | 167 |
| 60% | 164 | 60% | 165 | 45% | 167 |
| 70% | 164 | 70% | 165 | 65% | 167 |
| 80% | 164 | 80% | 165 | 80% | 167 |
| 90% | 164 | 90% | 165 | 90% | 167 |
| 94% | 170 | 97% | 168 | 95% | 169 |
| 96% | 176 | 98% | 176 | 97% | 175 |
| 97% | 177 | | | 98% | 184 |

Figure 3:
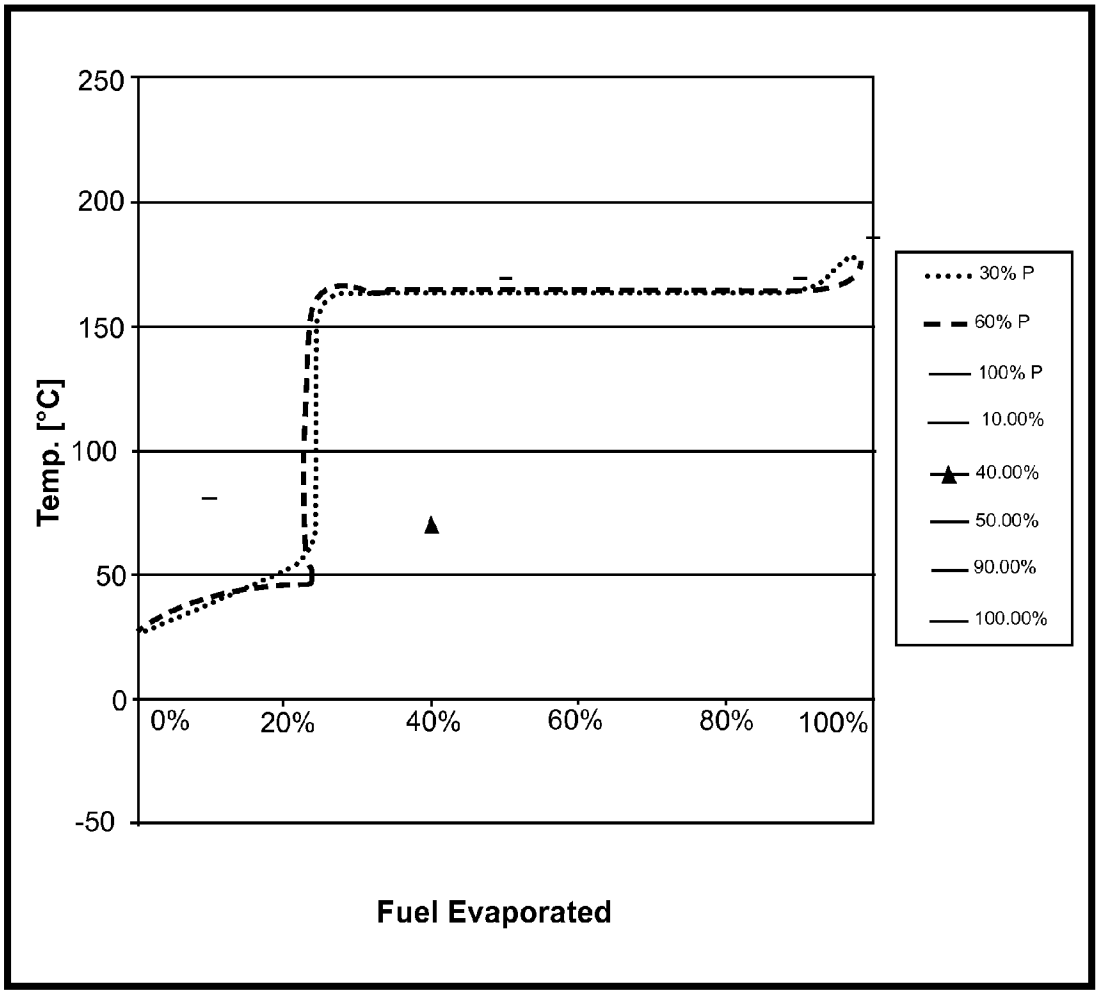
FIG. 3 is a graph of distillation curves for blends comprising an 80% component comprising pseudocumene and mesitylene, with the mixture including (a) 30% pseudocumene, (b) 60% pseudocumene, or (c) 100% pseudocumene by wt, plus a constant component of 20% isopentane.

The resulting distillation curves were then plotted in relation to the ASTM D7719 requirements for unleaded aviation gasoline. See FIG. 3. The curves all fell within appropriate tolerances.

Correlation of MON, RVP, and Distillation

Based upon the collective findings above, the experiments were further refined to isolate preferred mixtures of the three components to achieve an aviation fuel within the tolerance of acceptable minimum Motor Octane Number Reid Vapor Pressure limits and distillation curve constraints.

Testing was initially exemplified based on formulations having between 15.5% and 21.2% by weight isopentane or alternatively 10.5% to 16.2% isopentane blended in a mixture with up to 5% wt butane. This range of isopentane has previously been identified by applicants as providing sufficient RVP to allow blended components to meet the minimum specifications for aviation gasoline. The tests used blends of 1,2,4-trimethylbenzene and 1,3,5-trimethylbenzene as a 78.8% to 84.5% blend by weight, with the balance being isopentane. These formulations unexpectedly achieved the required Motor Octane Number, RVP and distillation requirements for various grades of aviation fuel. See Table 4.

Figure 4:
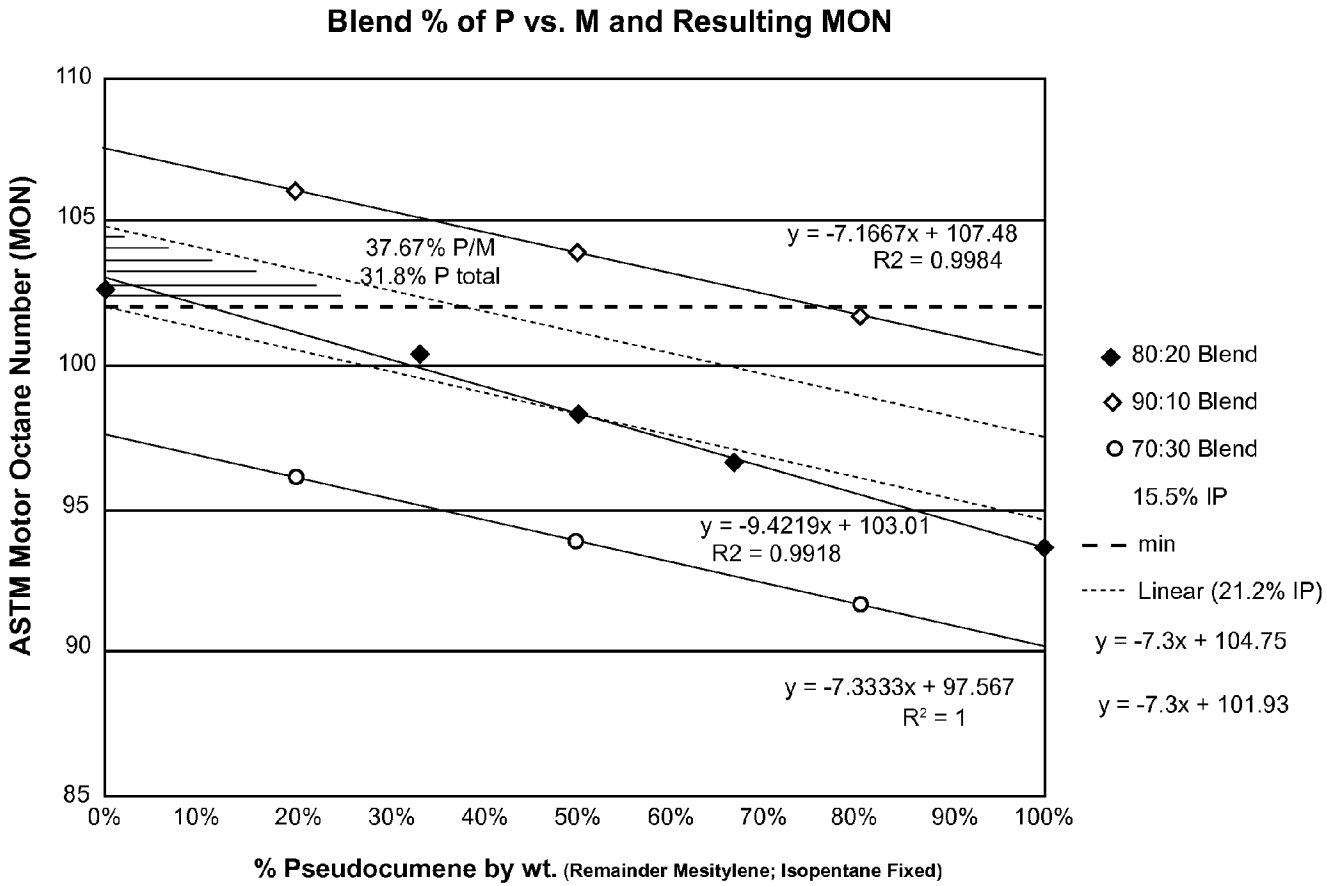
FIG. 4 is a graph showing various blends of pseudocumene, mesitylene and isopentane and the respective ASTM Motor Octane Numbers.

In this example, a blend of 34.56% pseudocumene, 49.73% mesitylene and 15.71% isopentane resulted in a minimum MON of 102. Also, a blend of 42.25% pseudocumene with only 42.25% mesitylene (50% pseudocumene and 50% mesitylene) and 15.5% isopentane yields a minimum 98 MON aviation fuel. See FIG. 4.

TABLE 4

Table 4 - Fuel Composition and Resulting MON

| | % Weight | | | MON | Fuel Composition as % Volume | | |
|---|---|---|---|---|---|---|---|
| M | Isopentane | Pseudocumene | Mesitylene | Rating | Isopentane | Pseudocumene | Mesitylene |
| I | 15.50% | 83.92% | 0.58% | 97.5 | 20.58% | 78.87% | 0.55% |
| N | 15.50% | 78.13% | 6.37% | 98 | 20.57% | 73.38% | 6.05% |
| | 15.50% | 66.56% | 17.94% | 99 | 20.54% | 62.42% | 17.04% |
| | 15.50% | 54.98% | 29.52% | 100 | 20.51% | 51.50% | 27.99% |
| R | 15.50% | 43.41% | 41.09% | 101 | 20.48% | 40.60% | 38.92% |
| V | 15.50% | 31.83% | 52.67% | 102 | 20.45% | 29.73% | 49.81% |
| P | 15.50% | 20.26% | 64.24% | 103 | 20.43% | 18.89% | 60.68% |
| | 15.50% | 8.68% | 75.82% | 104 | 20.40% | 8.09% | 71.51% |
| | 15.50% | 0.58% | 83.92% | 104.7 | 20.38% | 0.54% | 79.08% |
| A | 21.20% | 78.15% | 0.65% | 94.1 | 27.54% | 71.86% | 0.60% |
| X | 21.20% | 68.44% | 10.36% | 95 | 27.51% | 62.85% | 9.64% |
| | 21.20% | 57.64% | 21.16% | 96 | 27.47% | 52.87% | 19.65% |
| | 21.20% | 46.85% | 31.95% | 97 | 27.44% | 42.92% | 29.64% |

TABLE 4-continued

Table 4 - Fuel Composition and Resulting MON

| | % Weight | | | MON | Fuel Composition as % Volume | | |
|---|---|---|---|---|---|---|---|
| M | Isopentane | Pseudocumene | Mesitylene | Rating | Isopentane | Pseudocumene | Mesitylene |
| R | 21.20% | 36.05% | 42.75% | 98 | 27.41% | 32.99% | 39.61% |
| V | 21.20% | 25.26% | 53.54% | 99 | 27.37% | 23.08% | 49.54% |
| P | 21.20% | 14.46% | 64.34% | 100 | 27.34% | 13.20% | 59.46% |
| | 21.20% | 3.67% | 75.13% | 101 | 27.30% | 3.35% | 69.35% |
| | 21.20% | 0.43% | 78.37% | 101.3 | 27.29% | 0.39% | 72.31% |

Min RVP = Reid Vapor Pressure 38 kPa at 37.8° C. (using ASTM D5191)
Max RVP = Reid Vapor Pressure 49 kPa at 37.8° C. (using ASTM D5191)
MON = Motor Octane Number (using ASTM D2700)

As described herein, the present invention therefore provides an unleaded, piston engine fuel formulation comprising a blend of mesitylene, pseudocumene and isopentane and having a MON of at least 94 and an RVP of 38 to 49 kPa at 37.8° C. In one embodiment, the foregoing formulation comprises about 15.5% to about 21.2% isopentane by weight. In alternate embodiments, the formulations comprises a blend of mesitylene, pseudocumene, and about 15.5% to about 21.2% isopentane by weight, and are further characterized in having the following proportions of mesitylene and pseudocumene and in having the following MON:

a. up to 10% mesitylene by weight and 68-84.5% pseudocumene by weight, and a MON of at least 94;
b. up to 20% mesitylene by weight and 57-84.5% pseudocumene by weight, and a MON of at least 95;
c. up to 30% mesitylene by weight and 47-84.5% pseudocumene by weight, and a MON of at least about 96;
d. up to 42% mesitylene by weight and 36-84.5% pseudocumene by weight, and a MON of at least about 97;
e. 6-53% mesitylene by weight and 25-78.1% pseudocumene by weight, and a MON of at least about 98;
f. 18-64% mesitylene by weight and 14-66.6% pseudocumene by weight, and a MON of at least about 99;
g. 29-84.5% mesitylene by weight and 4-55% pseudocumene by weight, and a MON of at least about 100;
h. 41-84.5% mesitylene by weight and 1-43% pseudocumene by weight, and a MON of at least about 101.
i. 53-84.5% mesitylene by weight and 1-32% pseudocumene by weight, and a MON of at least about 102.
j. 64-84.5% mesitylene by weight and 1-20% pseudocumene by weight, and a MON of at least about 103; or
k. 75.8-84.5% mesitylene by weight and 1-8.7% pseudocumene by weight, and a MON of at least about 104;

In another aspect, the formulations consist essentially of mesitylene, pseudocumene and isopentane. Such embodiments further include embodiment consisting essentially of a blend of mesitylene, pseudocumene and isopentane and having a MON of at least 94 and an RVP of 38 to 49 kPa at 37.8° C. In one such embodiment, the formulation consists essentially of about 15.5% to about 21.2% isopentane by weight. In alternate embodiments, the formulations consist essentially of a blend of mesitylene, pseudocumene, and about 15.5% to about 21.2% isopentane by weight, and are further characterized in having the proportions of mesitylene and pseudocumene and in having the MON as set forth in subparagraphs a-k, immediately above. In yet another embodiment, the formulation consists of mesitylene, pseudocumene and isopentane.

In another aspect of the invention, there is provided an unleaded, piston engine fuel formulation comprising a blend of mesitylene, pseudocumene, isopentane and at least one other component selected from the group consisting of alkylates or alkanes and having a MON of at least 94 and an RVP of 38 to 49 kPa at 37.8° C. In a related aspect, this formulation consists essentially of mesitylene, pseudocumene, isopentane and up to 6% by weight of at least one additive selected from the group consisting of octane boosters, antioxidants, co-solvents, toluene, xylene, electrical conductivity additives, corrosion inhibitors, metal deactivators, dyes, and any combinations and mixtures thereof. Specifically, the latter embodiments may comprise alkylates or alkanes, or a combination of alkylates and alkanes. In one preferred embodiment, such formulation comprises 45-84.5% mesitylene by weight, up to 45% pseudocumene by weight, 15.5-21.2% isopentane by weight, and up to 20% alkylates or alkanes by weight. In a further embodiment, this formulation comprises up to 5% butane.

Another aspect of the present invention is the provision of an unleaded, piston engine fuel formulation consisting essentially of a blend of mesitylene, isopentane and at least one of the group consisting of pseudocumene, xylene and toluene, the formulation having a MON of at least 94 and an RVP of 38 to 49 kPa at 37.8° C. In related aspects, the formulation consists essentially of mesitylene, isopentane and xylene. Another embodiment provides a formulation of consisting essentially of mesitylene, isopentane and toluene, and a further embodiment is a formulation consisting essentially of mesitylene, isopentane, pseudocumene, xylene and toluene. These formulations in certain embodiments have a MON of at least 102.

The fuel formulations of the present invention are characterized herein in several respects. The included components are identified and ranges of those components are indicated. In making these indications of ranges, it is intended that the specific amounts of each component used in a particular formulation are selected based on certain additional stated criteria such as MON and RVP. It is within the ordinary skill in the art, given the teachings herein, to determine whether particular formulations satisfy the criteria as set forth in the claims.

Throughout this disclosure various components for the inventive fuel formulations have been identified. It will be appreciated that it is not necessary for these components to be in a pure form. It is only necessary that the formulations not include a deleterious amount of other components, particularly so as to cause the MON or RVP to fall outside the stated ranges. At the same time, the present invention may use materials which satisfy these conditions and are less expensive and/or more readily available than more pure grades of components. By way of example, mesitylene may be obtained as a mixture with minor amounts of other C6 to C10 aromatics, and such products may be usefully employed in accordance with the present invention.

Octane Boosters:

A variety of fuel additives have been known and used in the art to increase octane ratings, and thereby reduce knocking. Typical "octane booster" gasoline additives include methyl tert-butyl ether (MTBE) and ethyl tert-butyl ether (ETBE), both of which are known as oxygenates because they raise the oxygen content of gasoline. Oxygenates help gasoline burn more completely, reducing tailpipe emissions. Isooctane and toluene are among other known octane boosters.

Some embodiments may utilize no-leaded octane enhancing additives individually or in combination with up to 6% by weight that are deemed low in environmental toxicity, such as phenylamine, 4-methylphenylamine 3,5-dimethylphenylamine, ethers such as diisopropyl ether, triptane and other known octane boosters.

Tetraethyl lead, abbreviated TEL, is an organolead compound with the formula $(CH_3CH_2)_4Pb$. It has been mixed with gasoline since the 1920's as an inexpensive octane booster which allowed engine compression to be raised substantially, which in turn increased vehicle performance and fuel economy. These fuels have been referred to as low lead, or "LL". One advantage of TEL is the very low concentration needed. Other anti-knock agents must be used in greater amounts than TEL, often reducing the energy content of the gasoline. However, TEL has been in the process of being phased out since the mid-1970s because of its neurotoxicity and its damaging effect on catalytic converters. Most grades of avgas have historically contained TEL.

This invention advantageously produces an unleaded grade of avgas which allows a range of piston engines, including high-compression engines, to perform effectively. Therefore, in a preferred embodiment the inventive formulations and blends are unleaded, i.e., free of TEL. This is made possible, at least in part, by the presence of the 1,3,5-trimethylbenzene, which provides sufficiently high MON performance and anti-knocking characteristics under stress to offset the absence of TEL in the aviation gasoline. It is an object of the present invention to provide avgas formulations that do not require deleterious octane boosters, and which meet or exceed requirements for aviation gasoline.

The formulations are also useful for combining with other fuel components to form blends that are useful as motor fuels, including as aviation gasoline. As used herein, the term "fuel components" refers to materials which are themselves combustible and have varying motor octane ratings and are included primarily to provide improved combustion characteristics of the blend. In preferred embodiments, such fuel components are present in the blend at less than 5 wt %, and more preferably less than 1 wt %.

Blending of the formulations described herein can be performed in any suitable order. The examples and exemplary language provided herein are intended to better illuminate the invention and do not pose a limitation on the scope of the invention unless otherwise claimed. No language in the specification should be construed as indicating any non-claimed element as essential to the practice of the invention.

The use of a high octane aromatic base of aviation gasoline (typically 45% to 85%) based upon a large proportion of mesitylene and/or pseudocumene is strikingly different from other avgas formulations which are typically based upon alkylates. The tests have shown that mesitylene is one of the least toxic aromatics (allowing direct exposure to be metabolized by the human body, and excreted in the urine). Furthermore, mesitylene is one of the least aggressive aromatics in material compatibility tests on airplane fuel system components, allowing pilots to not replace engine or fuel parts outside of the normal maintenance cycle. Carbon buildup on the engine has been shown to be minimal. In one embodiment of this invention, to accommodate the need for cold starts, the addition of up to 20% wt of aviation alkylates or alkanes plus a sufficient amount of isopentane admixed with up to 5% butane for vapor pressure and from 0% to 6% of octane booster can result in an unleaded avgas that is safe and powerful for high performance piston engines.

It is a further purpose and advantage of the present invention to provide fuel formulations which have preferred components for other reasons. For example, the present formulations may be accurately referred to as comprising high aromatics and being hydrocarbon based. While other components may be included, preferred formulations are substantially free, or even completely free, of such other materials as oxygenates, sulfates and aromatic amines.

The inventive fuels may "comprise" the described formulations, in which other components may be included. However, in a preferred embodiment, the inventive fuels "consist of" the described formulations, in which no other components are present.

In addition, the inventive fuels may "consist essentially of" the formulations, in which case other fuel excipients may be included. As used herein, the term "fuel excipients" refers to materials which afford improved performance when used with fuels, but which do not directly participate in the combustion reactions. Fuel excipients thus may include, for example, antioxidants, etc.

All component percentages expressed herein refer to percentages by weight of the formulation, unless indicated otherwise. Given the similarity of the densities of the components of the present invention, it will be appreciated that the use of volume or weight percents of the components in the ranges indicated provide comparable results.

The uses of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein.

While the invention has been illustrated and described in the foregoing description, the same is to be considered as illustrative and not restrictive in character, it being understood that only certain preferred embodiments have been described and that all changes and modifications that come within the spirit of the invention are desired to be protected. In addition, all references cited herein are indicative of the level of skill in the art and are hereby incorporated by reference in their entirety.

The invention claimed is:

1. An unleaded, piston engine fuel formulation comprising a blend of mesitylene, pseudocumene and isopentane having a MON of at least 94 and an RVP of 38 to 49 kPa at 37.8° C., the formulation comprising about 15.5% to about 21.2% isopentane by weight.

2. The formulation of claim 1 comprising up to 10% mesitylene by weight and 68-84.5% pseudocumene by weight.

3. The formulation of claim 1 comprising up to 20% mesitylene by weight and 57-84.5% pseudocumene by weight, the formulation having a MON of at least 95.

4. The formulation of claim 1 comprising up to 30% mesitylene by weight and 47-84.5% pseudocumene by weight, the formulation having a MON of at least about 96.

5. The formulation of claim 1 comprising up to 42% mesitylene by weight and 36-84.5% pseudocumene by weight, the formulation having a MON of at least about 97.

6. The formulation of claim 1 comprising 6-53% mesitylene by weight and 25-78.1% pseudocumene by weight, the formulation having a MON of at least about 98.

7. The formulation of claim 1 comprising 18-64% mesitylene by weight and 14-66.6% pseudocumene by weight, the formulation having a MON of at least about 99.

8. The formulation of claim 1 consisting of mesitylene, pseudocumene and isopentane.

9. An unleaded, piston engine fuel formulation comprising:

a blend of mesitylene, pseudocumene, about 15.5 to about 21.2 wt % of isopentane and at least one of the group consisting of alkylates or alkanes and having a MON of at least 94 and an RVP of 38 to 49 kPa at 37.8° C.

10. The formulation of claim 9 comprising mesitylene pseudocumene, isopentane and up to 6% by weight of at least one additive selected from the group consisting of octane boosters, antioxidants, co-solvents, toluene, xylene, electrical conductivity additives, corrosion inhibitors, metal deactivators, dyes, and any combinations and mixtures thereof.

11. The formulation of claim 9 comprising alkylates.

12. The formulation of claim 9 comprising alkanes.

13. The formulation of claim 9 comprising alkylates and alkanes.

14. An unleaded, piston engine fuel formulation comprising: a blend of 45-84.5% mesitylene by weight, pseudocumene in an amount not to exceed 45% by weight, 1.5-21.2% isopentane by weight, and alkylates or alkanes, and having a MON of at least 94 and an RVP of 38 to 49 kPa at 37.8° C.

15. The formulation of claim 14 further comprising up to 5% butane.

16. An unleaded, piston engine fuel formulation comprising a blend of mesitylene, about 15.5 to about 21.2 wt % of isopentane, pseudocumene, xylene and toluene, the formulation having a MON of at least 94 and an RVP of 38 to 49 kPa at 37.8° C.

17. The formulation of claim 16 and having a MON of at least 102.

* * * * *